US010395586B2

(12) United States Patent
Kim

(10) Patent No.: US 10,395,586 B2
(45) Date of Patent: Aug. 27, 2019

(54) DISPLAY DEVICE, ELECTRONIC APPLIANCE INCLUDING THE SAME, AND EXTERNAL POWER SUPPLY DEVICE

(71) Applicant: LG Display Co., Ltd., Seoul (KR)

(72) Inventor: Young-In Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/921,875

(22) Filed: Oct. 23, 2015

(65) Prior Publication Data

US 2016/0125800 A1 May 5, 2016

(30) Foreign Application Priority Data

Oct. 31, 2014 (KR) ..... 10-2014-0150716

(51) Int. Cl.
*G09G 3/3208* (2016.01)
*G09G 3/20* (2006.01)
*G09G 3/3225* (2016.01)

(52) U.S. Cl.
CPC ..... *G09G 3/3208* (2013.01); *G09G 3/2003* (2013.01); *G09G 3/3225* (2013.01); *G09G 2310/08* (2013.01); *G09G 2330/025* (2013.01)

(58) Field of Classification Search
CPC .. G09G 3/3208; G09G 3/3225; G09G 3/2003; G09G 2310/08; G09G 2330/025; G09G 3/2813
See application file for complete search history.

(56) References Cited

U.S. PATENT DOCUMENTS 5,712,650 A * 1/1998 Barlow ..... G09G 3/24 345/55
2007/0290874 A1* 12/2007 Nearhoof ..... H05B 37/0209 340/815.46

(Continued)

FOREIGN PATENT DOCUMENTS

CN 1877675 A 12/2006
CN 101059944 A 10/2007

(Continued)

OTHER PUBLICATIONS

European Extended Search Report, European Application No. 15192245.7, dated Jun. 29, 2016, 15 pages.

(Continued)

*Primary Examiner* — Michael A Faragalla
*Assistant Examiner* — Chayce Bibbee
(74) *Attorney, Agent, or Firm* — Fenwick & West LLP

(57) ABSTRACT

An electronic appliance includes a display device and a power supply device providing a driving voltage to the display device. The display device avoids high inrush current to provide high quality display. The display device is connected to a power supply device providing a driving power to the display device. The display device comprises a display panel having a plurality of data lines and gate lines crossing each other, a plurality of pixels arranged in matrix form defined by the data and gate lines, a data driver, a gate driver, a timing controller adapted to control the data and gate drivers. The timing controller is adapted to control the driving of each gate line of the gate driver to correspond to a zero-cross point of the driving power supplied from the power supply device for driving the display panel.

13 Claims, 9 Drawing Sheets

(56) References Cited

U.S. PATENT DOCUMENTS

| | | | | |
|---|---|---|---|---|
| 2009/0310688 | A1* | 12/2009 | Ikeda | H04B 3/544 375/257 |
| 2012/0086427 | A1* | 4/2012 | Gotou | H02M 1/083 323/311 |
| 2013/0050292 | A1* | 2/2013 | Mizukoshi | G09G 3/3291 345/690 |
| 2014/0152633 | A1* | 6/2014 | Park | G09G 3/3291 345/207 |
| 2014/0176516 | A1 | 6/2014 | Kim et al. | |
| 2015/0048835 | A1* | 2/2015 | Lee | G01R 31/024 324/414 |

FOREIGN PATENT DOCUMENTS

| | | | |
|---|---|---|---|
| CN | 101582590 | A | 11/2009 |
| WO | WO 97/07493 | A1 | 2/1997 |

OTHER PUBLICATIONS

Cuk, V. et al., "Inrush Related Problems Caused by Lamps with Electronic Drivers and Their Mitigation" Recent Researches in System Science, Electrical Engineering Department, Electrical Energy Systems Eindhoven University of Technology, Aug. 18, 2011, pp. 321-326, [Online] [Retrieved on Feb. 22, 2016] Retrieved from the Internet<URL:http://www.wseas.us/e-library/conferences/2011/Corfu/SYSTEMS/SYSTEMS-52.pdf>.

European Partial Search Report, Europe Application No. 15192245.7, dated Mar. 14, 2016, 9 pages.

Winkel, E.T., "Dimmer-Arduino," Arduino diy, Oct. 19, 2012, 6 pages, [Online] [Retrieved on Feb. 22, 2016] Retrieved from the Internet<URL: https://arduinodiy.wordpress.com/2012/10/19/dimmer-arduino/>.

Chinese First Office Action, Chinese Application No. 201510733335.9, dated Dec. 27, 2017, 18 pages.

* cited by examiner

DISPLAY DEVICE, ELECTRONIC APPLIANCE INCLUDING THE SAME, AND EXTERNAL POWER SUPPLY DEVICE

CROSS-REFERENCE TO RELATED APPLICATION

This application claims priority from and the benefit under 35 U.S.C. § 119(a) of Korean Patent Application No. 10-2014-0150716, filed on Oct. 31, 2014, which is hereby incorporated by reference for all purposes in its entirety.

BACKGROUND OF THE INVENTION

1. Field of the Invention

The present invention relates to an electronic appliance having display device that displays an image and to a method for operating a display device. Further it relates to a display device and to a power supply device.

2. Description of the Prior Art

With the development of information-oriented society, requests for display devices for displaying an image have increased in various forms. Various types of display devices, such as a Liquid Crystal Display (LCD), a plasma display device, and an organic light emitting display device, are utilized.

Such a display device includes a display panel, in which a plurality of data lines and a plurality of gate lines are arranged, and a plurality of pixels are arranged, a data driver that drives the plurality of data lines, a gate driver that drives the plurality of gate lines, and a timing controller that controls the data driver and the gate driver.

The data driver receives digital video data (RGB (red, green, and blue)) input thereto, converts the digital video data into a data voltage Vdata in an analog form, and supplies the data voltage to the plurality of data lines so as to drive each of the data lines.

The gate driver sequentially supplies a scan signal of ON voltage or OFF voltage to the plurality of gate lines so as to sequentially drive each of the gate lines.

The display device is driven by receiving an alternating current (AC) power from an external power supply device, and when the gate drive sequentially drives each of the gate lines according to a control signal from the timing controller, an inrush current is generated in a load in proportion to the voltage of the AC power from the power supply device. That is, when the voltage of the AC power is low at the driving timing of each gate line, a low inrush current is generated. Whereas, when the voltage of the AC power is high at the driving timing of each gate line, an excessive inrush current is generated in the load, and the excessive inrush current drops the voltage of the load.

SUMMARY OF THE INVENTION

An object of the present invention is to provide an electronic appliance being coupled to a display device, which avoids high inrush current to provide high quality in displaying images. Furthermore, it is an object to provide a power supply device coupled to a display device, which allows the display device to adopt the driving to the characteristic of the supplied power.

The main idea of the present invention is to consider the characteristic and/or behavior of the supplied power when driving the display device, in particular, to avoid driving a gate line when the supplied AC power is high at the time of driving.

The object is of the present invention is solved by the features of the independent claims. Preferred embodiments are given in the dependent claims.

According to one embodiment, a display device includes a display panel, a gate driver, and a timing controller. The display panel includes a plurality of data lines and a plurality of gate lines disposed therein. The gate driver drives the plurality of gate lines. The timing controller receives a zero-cross signal indicating a zero-cross point of a driving power supplied from an external power supply device for driving the display panel and generates a signal for controlling driving of each of the gate lines of the gate driver to be matched with the zero-cross signal.

According to another embodiment, an electronic appliance includes an external power supply device and a display device. The external power supply device generates a zero-cross signal by sensing a zero-cross point of a driving power for driving a display panel. The display device generates a signal for controlling a plurality of gate lines disposed on the display panel to be matched with the zero-cross signal provided from the external power supply device.

According to still another embodiment, an external power supply device includes a power source and a zero-cross sensing unit. The power source supplies a driving power for driving a display panel. The zero-cross sensing unit generates a zero-cross signal used for driving a gate of the display panel by sensing a zero-cross point of the driving power generated from the power source, and supplies the zero-cross signal to the display panel.

As described above, according to the embodiments, a gate control signal and a sensing signal are adapted to be generated to be matched with a zero-cross signal. Thus, it is possible to prevent generation of an excessive peak current at the time of driving gate lines.

According to the embodiments, each gate line is adapted to be driven at a zero-cross point. Thus, it is possible to prevent generation of an excessive peak current so that a voltage drop of a load can be prevented.

According to the embodiments, a zero-cross signal can be generated by detecting a zero-cross point of an external power supply.

In one aspect of the invention the object is solved by an electronic appliance including a display device, the display device is connected to a power supply device providing a driving power to the display device, the display device comprises a display panel having a plurality of data lines and gate lines crossing each other, a plurality of pixels arranged in matrix form defined by the data and gate lines, a data driver, a gate driver, a timing controller adapted to control the data and gate drivers, wherein the timing controller is adapted to control the driving of each gate line of the gate driver to correspond to a zero-cross point of the driving power supplied from the power supply device for driving the display panel.

Preferably, the timing controller may generate control signals for controlling the operation timing of the data driver and the gate driver based on the timing of the host system.

Preferably, the timing controller may generate the control signals according to a zero-cross signal provided from the power supply device.

Preferably, the power supply device may generate the zero-cross signal for the AC power received from outside and to provide the zero-cross signal to the timing controller for enabling the timing controller to output a gate control signal and/or a sensing signal to be matched with the zero-cross signal.

Preferably, the power supply device may generate the zero-cross signal before rectifying the driving voltage being supplied to the display device.

Preferably, the external power supply device may comprise at least a zero-cross sensing unit to generate the zero-cross signal.

Preferably, the external power supply device may further comprise a synchronization unit adapted to rectify the AC power to generate a half-wave rectified power and to transfer the rectified power to the zero-cross sensing unit.

Preferably, the zero-cross sensing unit may receive the half-wave rectified power and sense zero cross points where the voltage becomes zero in the half-wave rectified power so as to generate a zero-cross signal ZCS.

Preferably, the zero-cross sensing unit may provide the zero-cross signal having zero-cross points detected every half cycle of the AC power to the timing controller.

Preferably, the timing controller may output the gate control signals and/or sensing signals to be matched with the zero-cross points included in the zero-cross signal so that the timing when a gate line is turned ON and/or the timing when sensing is initiated are matched with the zero-cross points.

Preferably, the timing controller may provide at least one of the gate control signal and the gate start pulse to the gate driver in synchronization with the zero-cross points of the zero-cross signal.

Preferably, the synchronization unit may include a photo coupler performing half-wave rectification on the AC power supply.

Preferably, the display device is coupled to a system board on which at least one of a host system, an interface and the external power supply device is positioned. Some of these components might be realized as external device being coupled to the system board and/or to the display device.

Preferably, the external power supply device may generate at least one driving power including one of a driving input voltage, a logic power voltage and a high potential power voltage and to input the driving power to the power supply unit.

Preferably, the timing controller and the power supply unit are disposed on a control board, wherein the timing controller and the power supply unit are able to transfer signals with the data driver.

Preferably, the display panel may be operated in a display mode and a sensing mode for providing a sensing function and a compensation function.

Preferably, the sensing mode starts at a time when the power is turned OFF and the display panel performs a sensing processing according to a power OFF signal to store sensing data in a memory, wherein, when the power is turned ON thereafter, the display panel performs a compensation processing using the stored sensing data.

Preferably, while the power is turned ON, the sensing processing is performed in real time and the mode is changed to the sensing mode according to the predetermined timing to perform the sensing processing.

The object is also solved by a method for operating a display device comprising a display panel having a plurality of data lines and gate lines crossing each other, a plurality of pixels arranged in matrix form defined by the data and gate lines, a data driver, a gate driver, a timing controller, comprising the steps of: detecting zero-cross points in the power received from outside; and controlling the driving of each gate line of the gate driver corresponding to the detected zero-cross points.

Preferably, the power supply unit may supply power to the display panel, data driver, gate driver and/or the timing controller.

The object is also solved by a power supply device which comprises at least a zero-cross sensing unit to generate the zero-cross signal, which is supplied to a display device receiving a driving voltage from the power supply device. Preferably, the external power supply device comprises a synchronization unit adapted to rectify the AC power to generate a half-wave rectified power and to transfer the rectified power to the zero-cross sensing unit. The zero-cross sensing unit may receive the half-wave rectified power and sense zero cross points where the voltage becomes zero in the half-wave rectified power so as to generate a zero-cross signal ZCS. The zero-cross sensing unit may provide the zero-cross signal having zero-cross points detected per every half cycle of the AC power to a timing controller of the display device.

In a further aspect of the present invention a display device is provided comprising: a display panel including a plurality of data lines and a plurality of gate lines disposed therein; a gate driver configured to drive the plurality of gate lines; and a timing controller configured to generate a signal for controlling driving of each of the gate lines of the gate driver to correspond to a zero-cross point of a driving power supplied from an external power supply device for driving the display panel.

Preferably, the timing controller receives a zero-cross signal indicating the zero-cross point of the driving power supplied from the external power supply device for driving the display panel, and generates a signal for controlling the driving of each of the gate lines of the gate driver to be matched with the zero-cross signal.

Preferably, in a display mode in an active time of one frame section, the timing controller provides a gate control signal to the gate driver so that each of the gate lines is sequentially driven to be matched with the zero-cross signal.

Preferably, the gate control signal is a gate start pulse that controls a start timing of a gate pulse.

Preferably, in a sensing mode of a blank time of one frame section, the timing controller provides a sensing signal for sensing a pixel to the gate driver to be matched with the zero-cross signal.

Preferably, upon receiving a turn-OFF command from outside, the timing controller provides a sensing signal for sensing a pixel to the gate driver to be matched with the zero-cross signal.

Preferably, the sensing signal is a gate start pulse that controls a start timing of a gate pulse.

In a further aspect of the present invention an electronic appliance is provided comprising: an external power supply device configured to generate a zero-cross signal by sensing a zero-cross point of a driving power for driving a display panel; and a display device configured to generate a signal for controlling a plurality gate lines disposed on the display panel to be matched with the zero-cross signal provided from the external power supply device.

In a further aspect of the present invention an external power supply device is provided, comprising: a power source configured to supply a driving power for driving a display panel; and a zero-cross sensing unit configured to generate a zero-cross signal used for driving a gate of the display panel by sensing a zero-cross point of the driving power generated from the power source, and to supply the zero-cross signal to the display panel.

Preferably, the external power supply device comprises a synchronization unit configured to generate a half-wave rectified power obtained through half-wave rectification of the driving power and provide the half-wave rectified power to the zero-cross sensing unit.

BRIEF DESCRIPTION OF THE DRAWINGS

The above and other objects, features and advantages of the present invention will be more apparent from the following detailed description taken in conjunction with the accompanying drawings.

DETAILED DESCRIPTION OF THE EXEMPLARY EMBODIMENTS

Figure 1:
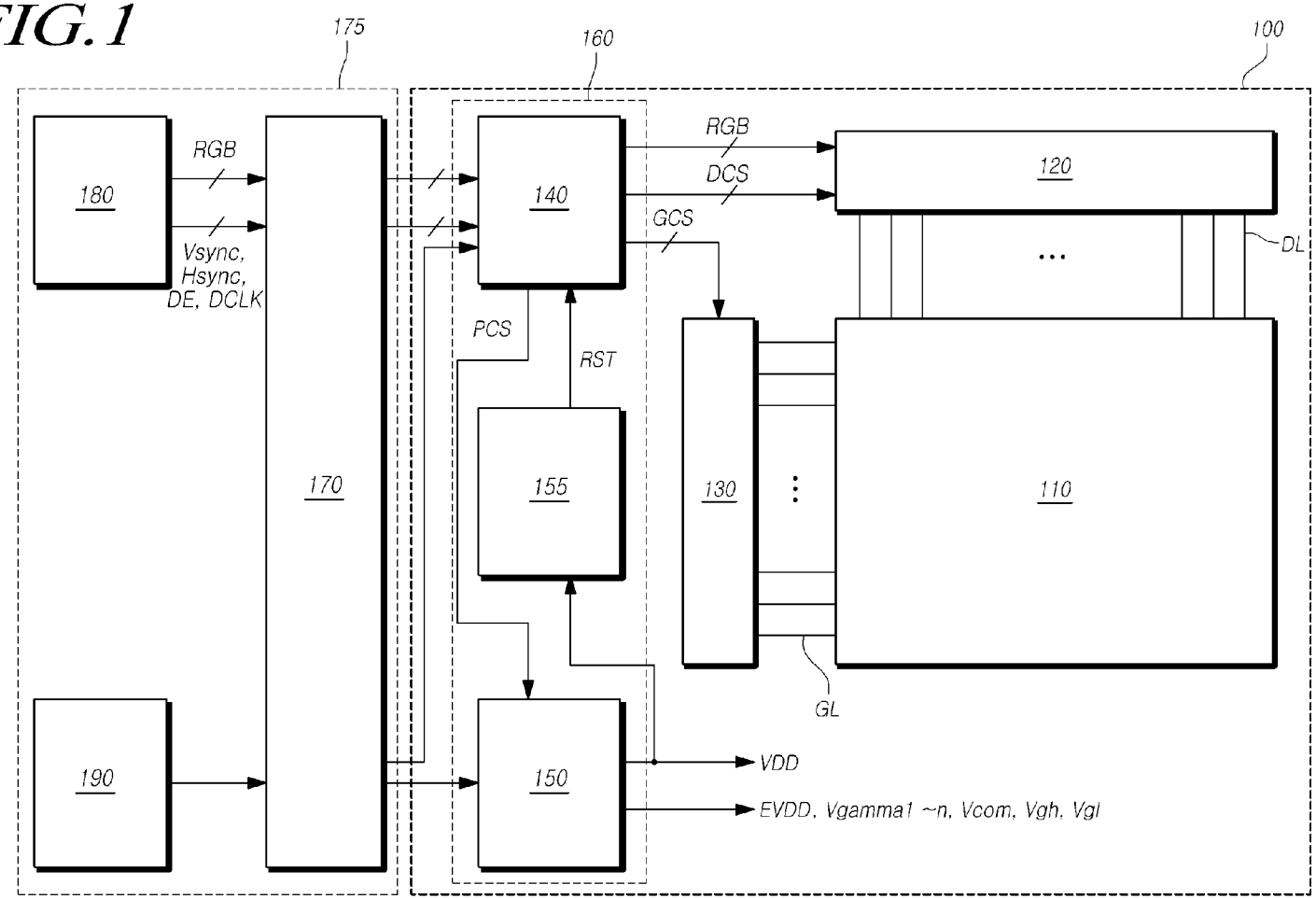
FIG. 1 is a system block diagram schematically illustrating an electronic appliance including an external power supply device and a display device, according to an embodiment.

Hereinafter, some embodiments of the present invention will be described in detail with reference to illustrative drawings. In adding reference signs to elements in each drawing, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 is a system block diagram schematically illustrating an electronic appliance including an external power supply device and a display device, according to an embodiment.

Referring to FIG. 1, an electronic appliance according to the present embodiments refers to an electronic appliance including a display device 100, such as a television system, a home theater, a set-top box, a navigation system, a DVD player, a blue-ray player, a personal computer, a phone system, a notebook personal computer, or a monitor.

The electronic appliance according to the present embodiments includes a display device 100 and a system board 175.

The display device 100 includes, for example, a display panel 110, in which a plurality of data lines, a plurality of gate lines, and a plurality of pixels are arranged, a plurality of drivers 120 and 130 that drive the display panel 110, a timing controller 140 that controls the drivers 120 and 130, and a power supply unit 150 that supplies a power.

On the system board 175, a host system 180 and an external power supply device 190 are positioned.

In the display panel 110, the data lines DL and the gate lines GL are arranged to cross each other. The display panel 110 includes the pixels arranged in a matrix form in the cell regions defined by the data lines DL and the gate lines GL.

A power supplied from the power supply unit 150 may be applied to the display panel 110 via the data driver 120. For power monitoring, the power may be applied to the bypass on a film on which the data driver 120 is disposed.

The plurality of drivers 120 and 130 include at least one data driver 120 that drives the plurality of data lines DL and at least one gate driver 130 that drives the plurality of gate lines GL.

The data driver 120 receives digital video data RGB input from the timing controller 140. The data driver 120 stores the input digital video data to a memory (not illustrated), converts the digital video data RGB into a data voltage Vdata in an analog form using a gamma reference voltage according to a control of the timing controller 140, and supplies the data voltage to the plurality of data lines DL so as to drive each data line DL.

The data driver 120 may be implemented by an integrated circuit. The data driver 120 may be connected to a bonding pad of the display panel 110 in a Tape Automated Bonding (TAB) manner or a Chip On Glass (COG) manner, or directly formed on the display panel 110. Occasionally, the data driver 120 may be formed by being integrated in the display panel 110.

The gate driver 130 is connected to the gate lines GL of the display panel 110 to sequentially output a gate signal to the gate lines GL. That is, the gate driver 130 sequentially supplies a scan signal of ON voltage or OFF voltage to the plurality of gate lines GL according to a control of the timing controller 140 so as to sequentially drive each of the gate lines GL.

The gate driver 130 may be implemented by an integrated circuit. The gate driver 130 may be connected to the bonding pad of the display panel 110 in the TAB manner or the COG manner, or implemented in a Gate Drive-IC In Panel (GIP) type to be directly formed in the display panel 110. Occasionally, the gate driver 130 may be formed by being integrated in the display panel 110.

Meanwhile, depending on a driving method, the gate driver 130 may be positioned only at one side of the display panel 110 or divisionally positioned at both sides of the display panel 110.

The timing controller 140 receives the digital video data RGB input from the external host system 180 via an interface, such as a Low Voltage Differential Signaling (LVDS) interface, a Transition Minimized Differential Signaling (TMDS) interface, or a Mobile Industrial Processor Interface (MIPI). The timing controller 140 transmits the digital video data RGB input from the host system 180 to the data driver 120.

In addition, the timing controller 140 receives a timing signal, such as vertical synchronous signal Vsync, a horizontal synchronous signal Hsync, a data enable signal DE, or a main clock DCLK, input from the host system 180, via the LVDS or TMDS interface.

The timing controller 140 generates control signals for controlling the operation timing of the data driver 120 and the gate driver 130 with reference to the timing signal from the host system 180. The control signals may include a gate control signal GCS for controlling the operation timing of the gate driver 130, a data control signal DCS for controlling the operation timing and the polarity of the data voltage of the data driver 120, and a power control signal PCS for controlling power generation and supply of the power supply unit 150. In addition, the control signals provided by the timing controller 140 includes a sensing signal required for performing a sensing function for sensing a unique characteristic value (e.g., threshold voltage or mobility) for an element of a transistor disposed in each pixel, as will be described with reference to FIGS. 2*a* and 2*b*.

The data control signal DCS includes, for example, a source start pulse SSP, a source sampling clock SSC, and a source output enable signal SOE. The gate control signal GCS includes, for example, a gate start pulse GSP, a gate shift clock GSC, and a gate output enable signal GOE. The gate start pulse GSP controls the start timing of a gate pulse. The gate shift clock GSC is a clock signal for shifting the gate start pulse GSP. The gate output enable signal GOE controls the output timing of the gate driving circuit.

The sensing signal may include signals that equal to, for example, the gate start pulse GSP, the gate shift clock GSC, and the gate output enable signal GOE of the gate control signal GCS. Meanwhile, the gate control signal GCS and the sensing signal may be used as the same signal. That is, the gate control signal for driving the gate lines may also be used as the sensing signal for driving a sensing line.

When generating the control signals, the timing controller 140 generates a signal for controlling the driving of each gate line of the gate driver to correspond to a zero-cross point of the driving power supplied from the external power supply device 190 for driving the display panel 110. More specifically, the timing controller 140 generates the control signals by adjusting the timing signal according to the zero-cross signal provided from the external power supply device 190 according to an embodiment of the present invention. A process for generating the zero-cross signal from the external power supply device 190 will be described later.

The power supply unit 150 supplies a power, a voltage, or a current used by the data driver 120, the gate driver 130, and the display panel 110.

Referring to FIG. 1 again, the timing controller 140 and the power supply unit 150 may be disposed on a control board 160 (also referred to as a "control printed circuit board"). The timing controller 140 and the power supply unit 150 are able to transfer signals to the data driver 120.

The display device 100 may be one of, for example, a liquid crystal display device, a plasma display device, and an organic light emitting display device.

Figure 2A:
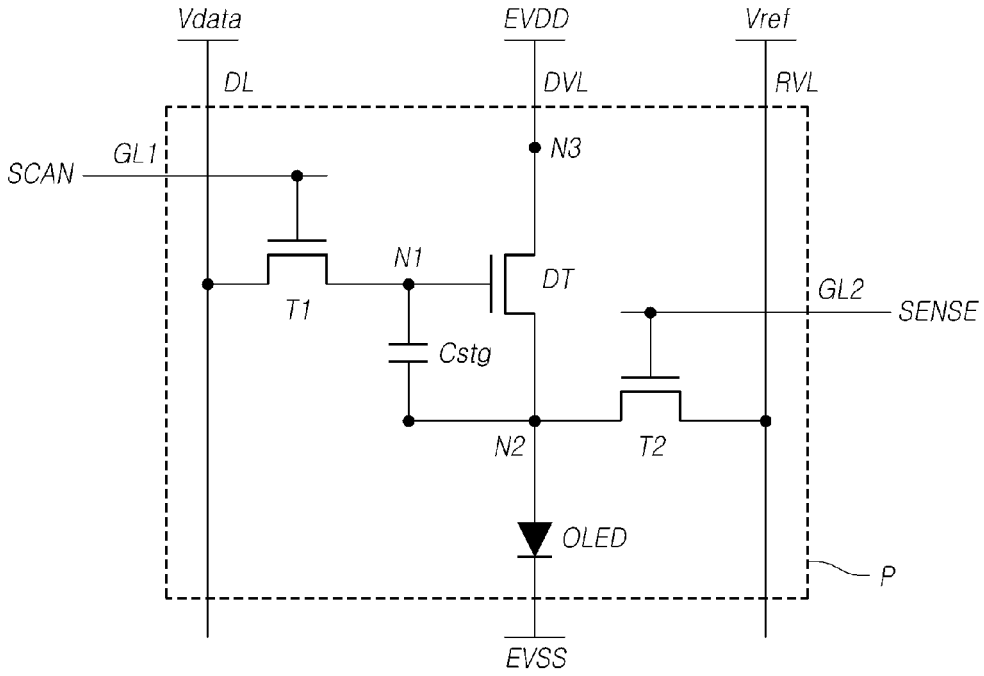
FIG. 2A is an equivalent circuit diagram for a pixel structure of each pixel P arranged in a display panel in a case where a display device according to embodiments is an organic light emitting display device.

FIG. 2A is an equivalent circuit diagram for a pixel structure of each pixel P arranged in a display panel 110 in a case where the display device 100 according to embodiments is an organic light emitting display device.

Referring to FIG. 2A, in the case where the display device 100 according to embodiments is an organic light emitting display device, each pixel P disposed in the display panel 110 has, for example, a 3T1C pixel including three transistors DT, T1, and T2 and one storage capacitor in addition to an Organic Light Emitting Diode (OLED).

More specifically, each pixel P includes: an organic light emitting diode OLED; a driving transistor DT connected between a node N3, to which a driving voltage EVDD is connected via a driving voltage line DVL, and the organic light emitting diode OLED; a first transistor T1 controlled by a first scan signal SCAN supplied through a first gate line GL1, and connected between a data line DL that supplies a data voltage Vdata and a first node N1 (gate node) of the driving transistor DT; a second transistor T2 controlled by a second scan signal SENSE supplied through a second gate line GL2, and connected between a node, to which a reference voltage Vref is supplied through a reference voltage line RVL, and a second node N2 (e.g., source node or drain node) of the driving transistor DT; and a storage capacitor Cstg connected between the first node N1 and the second node N2 of the driving transistor DT.

The first transistor T1 is turned ON or turned OFF by the first scan signal SCAN so as to apply the data voltage Vdata supplied thereto through the data line DL to the gate node N1 of the driving transistor DT that drives the organic light emitting diode OLED.

That is, the first transistor T1 is a switching transistor that switches the voltage applied to the gate node N1 of the driving transistor DT so as to control the driving transistor DT.

In addition, the second transistor T2 is a transistor that may apply a constant voltage Vref at the time of display driving during the blanking period of the display driving period and/or during sensing driving to the second node N2 of the driving transistor DT in order to initiate the second node N2. The constant voltage Vref is not applied to N2 during light emission period.

In addition, the second transistor T2 is turned ON for a predetermined length of time of a sensing mode section so as to allow the voltage of the second node N2 (e.g., source node or drain node) of the driving transistor DT to be sensed through the reference voltage line RVL.

Here, the reference voltage line RVL also serves as a sensing line where the voltage of the second node N2 (e.g., source node or drain node) of the driving transistor DT is sensed while serving as a line where the reference voltage Vref is supplied.

In each pixel P disposed in the display panel 110 illustrated in FIG. 2A, it has been described that the first gate line GL that supplies the first scan signal and the second gate line GL2 that supplies the second scan signal are separate from each other. However, the first gate line GL1 and the second gate line GL2 may be configured by one gate line.

Meanwhile, various circuit elements such as the transistors disposed in each pixel P of the display panel 110 have unique characteristic values. For example, the transistors have unique characteristic values such as a threshold voltage Vth and a mobility.

The unique characteristic values may be slightly different for each transistor. Due to this, a difference in brightness may occur between respective pixels. In particular, the transistors may be degraded as the driving time increases, and depending on a difference in degradation degree, the deviation of the unique characteristic values may further increase from transistor to transistor, and due to this, the deviation in brightness may become more severe between the pixels.

As a result, in an embodiment, the display device 100 provides a sensing function that senses unique characteristic values (e.g., threshold voltage and mobility) for the circuit elements such as the transistors disposed in each pixel, and a compensation function that progresses data compensation for changing data to be supplied to each pixel in order to compensate for the deviation in unique characteristic value between the circuit elements based on a sensed result (sensing data) obtained as a result of sensing the unique characteristic values of the circuit elements, that is the deviation in brightness between the pixels.

In order to provide the sensing function and the compensation function, the display panel 110 may be operated in a display mode and a sensing mode.

When the sensing mode progresses at the time when the power is turned OFF, the display panel 110 may perform a sensing processing according to a power OFF signal to store sensing data in the memory. Thereafter, when the power is turned ON, the display panel 110 may perform a compensation processing (data compensation processing) using the stored sensing data. That is, when a processing of turning OFF the power of the display device 100 is performed, the mode is changed to the sensing mode so that the sensing processing may be performed.

Figure 2B:
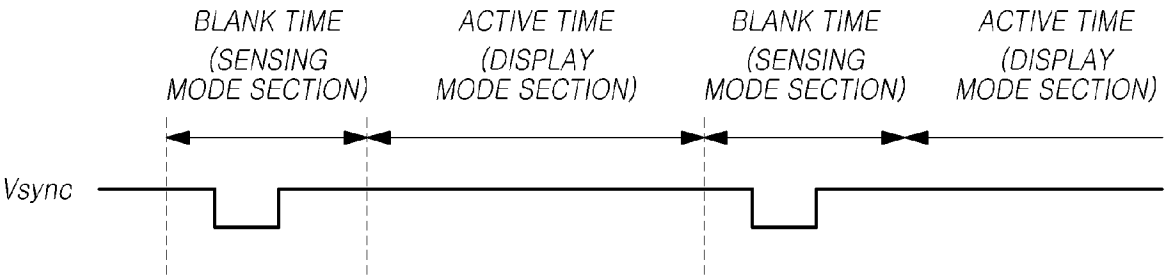
FIG. 2B is a timing chart illustrating sensing mode sections and display mode sections of a display device according to embodiments.

Occasionally, in the display panel 110 of the display device 100 according to embodiments, while the power is turned ON, the sensing processing may be performed in real time. That is, while the power of the display device 100 is turned ON, the mode is changed to the sensing mode according to the predetermined timing so that the sensing processing may be performed. FIG. 2B exemplifies sensing timing for this.

FIG. 2B is a timing chart illustrating sensing mode sections and display mode sections of a display device according to embodiments.

Referring to FIG. 2B, when the real time sensing function is applied while the power is turned ON, the display panel 110 of the display device 100 according to embodiments may be driven alternately in the display mode and the sensing mode. That is, the display panel 110 is operated in the display mode and the sensing mode in a time divisional manner.

For example, the display panel 110 may be driven such that one frame section is divided into one display mode section and one sensing mode section.

More specifically, one frame section may be divided into an active time and a blank time with reference to a vertical synchronous signal Vsync. In the active time, the display panel 110 may be driven in the display mode, and in the blank time, the display panel 110 may be driven in the sensing mode.

Referring to FIG. 1 again, the host system 180 positioned on the system board 175 generates a timing signal such as a vertical synchronous signal Vsync, a horizontal synchronous signal Hsync, a data enable signal DE, or a dot clock CLK, for example, through the LVDS interface or TMDS interface transmission circuit together with RGB video data input from a broadcasting reception signal or an external video source, and supplies the signals to the timing controller 140 via a user connector 170. The host system 180 may perform a graphic processing of, for example, a scaler that interpolates the resolution of the RGB video data input from the broadcasting reception circuit or the external video source to be suitable for the resolution of the display panel and performs signal interpolation.

When the power of the display device is turned ON, the external power supply device 190 positioned on the system board 175 may generate at least one driving power among a driving input voltage Vin, a logic power voltage VDD, and a high potential power voltage EVDD, and inputs the driving power to the power supply unit 150 through the user connector 170.

For example, when the external power supply device 190 generates the logic power voltage VDD and the high potential power voltage EVDD, and then supplies the logic power voltage VDD and the high potential power voltage EVDD to the power supply unit 150 of the control board 160 through the user connector 170, the power supply unit 150 supplies the logic power voltage VDD to, for example, the timing controller 140, and supplies the high potential power voltage EVDD to the timing controller 140 and the pixels or display elements of the display panel 110.

In another example, when the external power supply device 190 generates the driving input voltage Vin and then supplies the driving input voltage Vin to the power supply unit 150 of the control board 160 through the user connector 170, the power supply unit 150 generates the logic power voltage VDD and the high potential power voltage EVDD using the driving input voltage Vin and then, supplies the logic power voltage VDD to, for example, the timing controller 140 and supplies the high potential power voltage EVDD to the timing controller 140 and the pixels or display elements of the display panel 110.

The logic power voltage VDD is input to circuits of, for example, a reset circuit 155, the timing controller 140, the data driver 120, and the gate driver 130 to drive the circuits. Further, the high potential power voltage EVDD is supplied to the timing controller 140 and each of the pixels of the display panel 110 so as to initiate the normal driving. Although FIG. 1 illustrates that the reset circuit 155 is configured separately from the power supply unit 150, the reset circuit 155 may be configured in the power supply unit 150.

In the foregoing, it has been described that the external power supply device 190 is positioned on the system board 175, but the present invention is not limited thereto. For example, the external power supply device 190 may be independently positioned, for example, in a case or a frame of the electronic appliance illustrated in FIG. 1.

Figure 3:
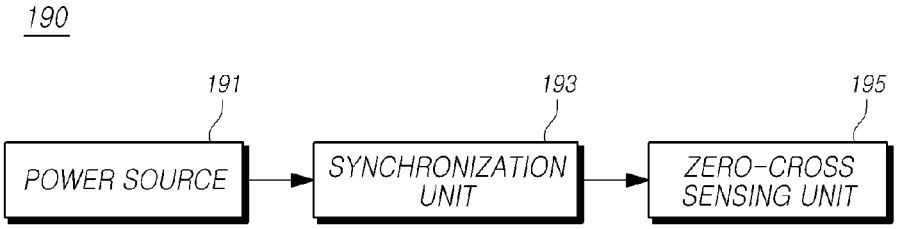
FIG. 3 is a block diagram of an external power supply device according to an embodiment of the present invention.

FIG. 3 is a block diagram of an external power supply device 190 according to an embodiment of the present invention.

Referring to FIG. 3, the external power supply device 190 of the present embodiment generates a zero-cross signal for the AC power received from outside and provides the zero-cross signal to the timing controller 140 so that the timing controller 140 outputs a gate control signal and a sensing signal to be matched with the zero-cross signal. As a result, when the voltage of the AC power is high, the gate control signal or the sensing signal is not output such that occurrence of an excessive inrush current can be prevented.

In order to generate the zero-cross signal, the external power supply device 190 may include a power source 191, a synchronization unit 193, and a zero-cross sensing unit 195.

The power source 191 is an external power supply that generates a power for driving the display panel and may use a 220V AC power supply having a frequency of, for example, 60 Hz, 120 Hz, or 240 Hz.

The synchronization unit 193 rectifies the AC power provided from the power source 191 and transfers the rectified power to the zero-cross sensing unit 195. At this time, the synchronization unit 193 rectifies the AC power from the power source 191 to generate a half-wave rectified power.

The zero-cross sensing unit 195 may be provided with the half-wave rectified power rectified and generated in the synchronization unit 193. The zero-cross sensing unit 195 senses zero cross points where the voltage becomes zero in the half-wave rectified power so as to generate a zero-cross signal ZCS.

In general the zero-cross point refers to a point where a certain waveform crosses a zero point. In an embodiment, the zero-cross point only includes a case where a waveform crosses the zero point while progressing from positive (+) to negative (−), but does not include a case in which a waveform crosses the zero point while progressing from negative (−) to positive (+). As a result, for one cycle of a sine wave (16.6 ms in the case of 60 Hz), only one zero-cross point is detected.

However, the present embodiment performs half-wave rectification on the AC power by the synchronization unit 193 so that the waveform progress from positive (+) to negative (−) at every half cycle. Thus, zero-cross points can be detected per every half cycle (8.3 ms in the case of 60 Hz).

The zero-cross sensing unit 195 provides a zero-cross signal having zero-cross points detected for every half cycle of the AC power to the timing controller 140. Then, the timing controller 140 outputs the above-described gate control signals and sensing signals to be matched with the zero-cross points included in the zero-cross signal so that the timing when a gate is turned ON and the timing when sensing is initiated are matched with the zero-cross points.

Figure 4:
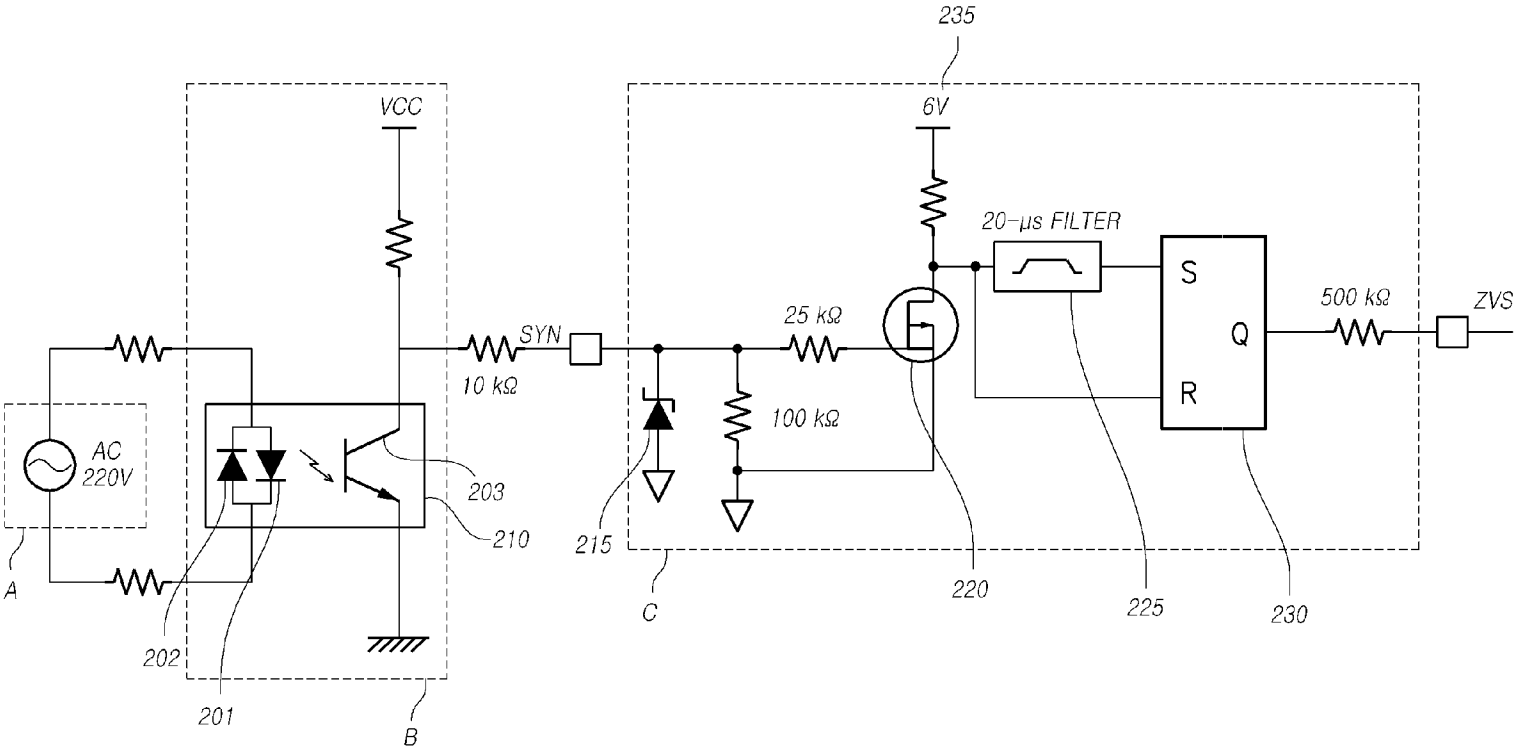
FIG. 4 is a circuit diagram of the external power supply device according to the embodiment of the present invention.

FIG. 4 is a circuit diagram of the external power supply device 190 according to the embodiment of the present invention. FIG. 4 is an exemplary circuit diagram. Since the circuit for detecting a zero-cross signal may be variously designed, the external power supply device 190 of the present invention is not limited to the circuit diagram exemplified in FIG. 3.

Figure 5A:
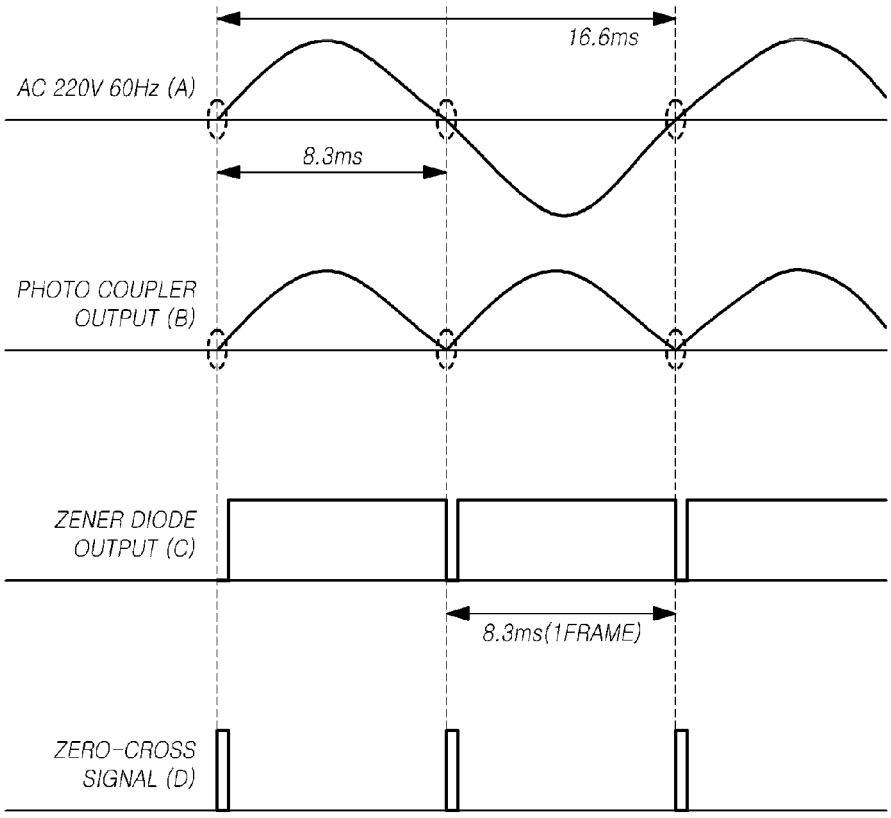
FIG. 5A is a signal diagram illustrating an external power waveform, a half-wave rectification waveform, a constant voltage waveform, and a zero-cross signal of the external power supply device of FIG. 4.
Figure 5B:
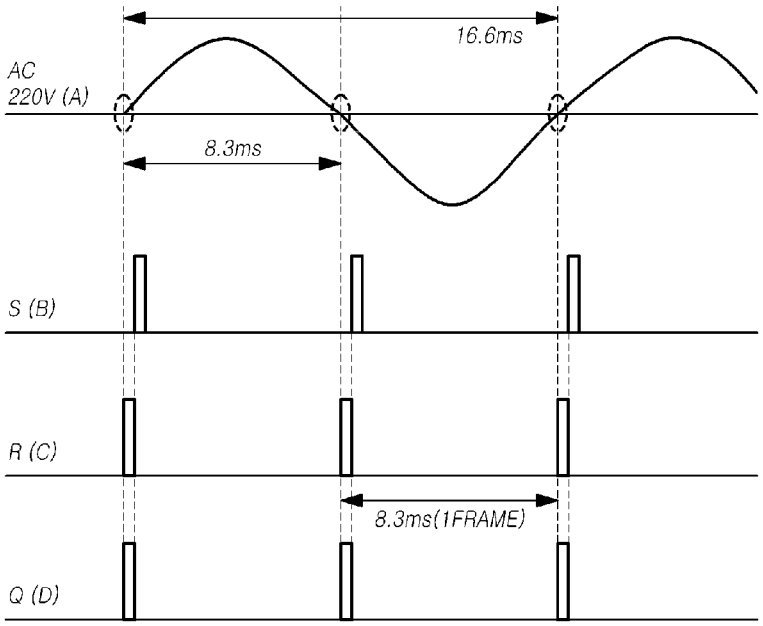
FIG. 5B is a signal diagram illustrating an external power waveform of the external power supply device of FIG. 4 and signals at the S-terminal, R-terminal, and Q-terminal of a flip-flop.

FIG. 5A is a view illustrating an external power waveform, a half-wave rectification waveform, a constant voltage waveform, and a zero-cross signal of the external power supply device 190 of FIG. 4. FIG. 5B is signal diagram illustrating an external power waveform of the external power supply device 190 of FIG. 4 and signals at the S-terminal, R-terminal, and Q-terminal of a flip-flop.

In FIG. 4, block A indicates a power source 191, block B indicates a synchronization unit 193, and block C indicates a zero-cross sensing unit 195.

The power source 191 may use, for example, an AC power of 60 Hz and 220 V, as illustrated in (A) of FIG. 5A.

The synchronization unit 193 may include a photo coupler 210 that performs half-wave rectification on the power source 191 which is an AC power supply, and is connected to the power source 191, and a first operation power VCC provided to the zero-cross sensing unit 195 according to the operation of the photo coupler 210.

The photo coupler 210 includes one pair of light emitting diodes 201 and 202, each of which is serially connected to the power source 191, and a transistor 203 that is switched by the light from the pair of light emitting diodes 201 and 202.

The one pair of light emitting diodes 201 and 202 are connected in parallel to each other, in which the light emitting diodes will be referred to as first and second light emitting diodes 201 and 202. Here, the first light emitting diode 201 is connected in a forward direction with respect to the power source 191, and the second light emitting diode 202 is connected in a reverse direction with respect to the power source 191. As a result, when the AC power is positive (+), a current flows in the first light emitting diode 201 so that the first light emitting diode 201 emits light, and when the AC power is negative (−), a current flows in the second diode 202 so that the second light emitting diode 202 emits light.

The transistor 203 is configured as an NPN transistor 203, in which the emitter is connected to the first operation power VCC, and the collector is connected to a ground GND. In addition, the base of the transistor 203 is disposed adjacent to the first and second light emitting diodes 201 and 202 so that the transistor 203 is switched by the light provided from the first and second light emitting diodes 201 and 202.

The first operation power VCC is connected to the emitter of the transistor 203, and a resistor is provided between the first operation power VCC and the emitter. Between the resistor and the emitter of the transistor 203, a power line is connected to provide the first operation power VCC to the zero-cross sensing unit 195.

Now the operation of the synchronization unit 193 will be described.

First, when a positive (+) AC power is supplied from the power source 191, a current flows in the first light emitting diode 201 so that the first light emitting diode 201 starts to emit light. When the first light emitting diode 201 starts to emit light, the transistor 203 starts its operation to control the flow of the current provided from the first operation power VCC depending on the amount of light emitted from the first light emitting diode 201. That is, as the amount of the light generated from the first light emitting diode 201 is increased, the amount of the current flowing in the transistor 203 is increased.

On the contrary, when a negative (−) AC power is supplied from the power source 191, a current flows in the second light emitting diode 202 so that the second light emitting diode 202 starts to emit light. When the second light emitting diode 202 starts to emit light, the transistor 203 starts to operate and controls the flow of the current provided from the first operation power Vcc depending on the amount of the light emitted from the second light emitting diode 202. That is, as the amount of the light emitted from the second light emitting diode 202 increases, the amount of the current flowing in the transistor 203 increases.

Thus, as the voltage of the positive (+) AC power increases and then decreases while describing a sine wave in the first half wavelength of the power source 191, the current flowing in the transistor 203 also increases and then decreases. Likewise, as the voltage of the negative (−) AC power increases and then decreases while describing the sine wave in the next half wavelength of the power source 191, the current flowing in the transistor 203 also increases and then decreases.

When the AC power from the power source 191 is rectified in the photo coupler 210 of the synchronization unit 193 as described above, a half-wave rectified power is generated by the first and second light emitting diodes 201 and 202 as illustrated in (B) of FIG. 5A, and the half-wave rectified power is transmitted to the zero-cross sensing unit 195. As the synchronization unit 193 performs the half-wave rectification on the AC power in this manner, it is possible to detect two zero-cross points per one cycle of a sine wave.

The external power supply unit 190 may not include the synchronization unit 193 as needed.

As illustrated in block C in FIG. 4, the zero-cross sensing unit 195 may include, for example, a zener diode 215, a MOSFET 220, and a flip-flop 230.

The zener diode 215 is generally capable of maintaining the voltage across the zener diode 215 constant to generate a constant voltage. The zener diode 215 of the zero-cross sensing unit 195 is provided with the half-wave rectified power output from the synchronization unit 193 and generates a reverse current with respect to the half-wave rectified power, thereby generating zener yield. Thus, when the half-wave rectified power from the synchronization unit 193 passes through the zener diode 215, a constant voltage with a pre-set level is generated as illustrated in (C) of FIG. 5A. The constant voltage is provided to the MOSFET 220 to turn ON/OFF the MOSFET 220.

The MOSFET 220 is configured as the P-channel, in which the gate is connected to the zener diode 215, and the source is connected to the power line extending between the zener diode 215 and the gate. In addition, the power line is connected to the ground. The drain of the MOSFET 220 is connected to a second operation power 235 for operating the flip-flop 230. For example, the second operation power 235 has a voltage value of 6V. The MOSFET 220 is turned ON while the constant voltage is provided from the zener diode 215, and turned OFF while the constant voltage is not provided.

When the constant voltage is provided from the zener diode 215 and the MOSFET 220 is turned ON, the second operation power 235 is discharged through the drain and the emitter so that no power is supplied to the flip-flop 230. Whereas, when no constant voltage is supplied from the zener diode 215, the MOSFET 220 is turned OFF, and the second operation power 235 of 6V is supplied to the flip-flop 230.

Meanwhile, the constant voltage is generated from the zener diode 215 in the case where the flow of the current in the transistor 203 of the photo coupler 210 is controlled and the power supplied from the power source 191 is larger than zero (0) or smaller than zero (0). That is, when the power supplied from the power source 191 is not zero (0), the constant voltage is generated from the zener diode 215, in which case the MOSFET 220 is turned ON so that no power is supplied to the flip-flop 230.

Whereas, the MOSFET 220 is turned OFF and the second operation power 235 is supplied to the flip-flop 230 in the case where no constant voltage is supplied from the zener diode 215 and the power supplied from the power source 191 is zero (0). That is, the section where the MOSFET 220 is turned OFF so that the second operation power 235 is supplied to the flip-flop 230 becomes a zero-cross section.

The flip-flop 230 is connected between the drain terminal of the MOSFET 220 and the second operation power 235, and the power line extending between the drain terminal of the MOSFET 220 and the second operation power 235 is divided into two, one of which is connected to the S-terminal of the flip-flop 230, and the other is connected to the R-terminal of the flip-flop 230. That is, both the S-terminal and R-terminal of the flip-flop 230 are connected between the drain terminal of the MOSFET 220 and the second operation power 235.

A delay filter 225 is provided on the power line connected to the S-terminal of the flip-flop 230 to delay the second operation power 235 supplied to the S-terminal of the flip-flop 230. At this time, the second operation power 235 supplied to the S-terminal is set to be delayed by a predetermined time, for example, 20 μs, by the delay filter 225. Thus, the second operation power 235 is supplied to the R-terminal earlier than the S-terminal, and after 20 μs delay, supplied to the S-terminal.

A signal input to the S-terminal of the flip-flop 230, a signal input to the R-terminal of the flip-flop 230, and a signal output from the Q-terminal of the flip-flop 230 are illustrated in (B) to (D) of FIG. 5B.

When the second operation power 235 is supplied to the flip-flop 230, the input signal of the R-terminal becomes 1, and the input signal of the S-terminal becomes 0. Thus, the output signal of the Q-terminal becomes 1. With the elapse of the delay time, the input signal of the R-terminal becomes 0, and the input signal of the S-terminal becomes 1. Thus, the output signal of the Q-terminal becomes 0. Thereafter, when both the input signals of the S-terminal and the R-terminal are 0, the output signal of the Q-terminal maintains 0.

Thus, the output signal of the Q-terminal of the flip-flop 230 is output as 1 at every zero-cross point of the power source 191 as illustrated in (D) of FIG. 5B. Thus, in the zero-cross sensing unit 195, the zero-cross signal as illustrated in (D) of FIG. 5A is output from the flip-flop 230.

Figure 6:
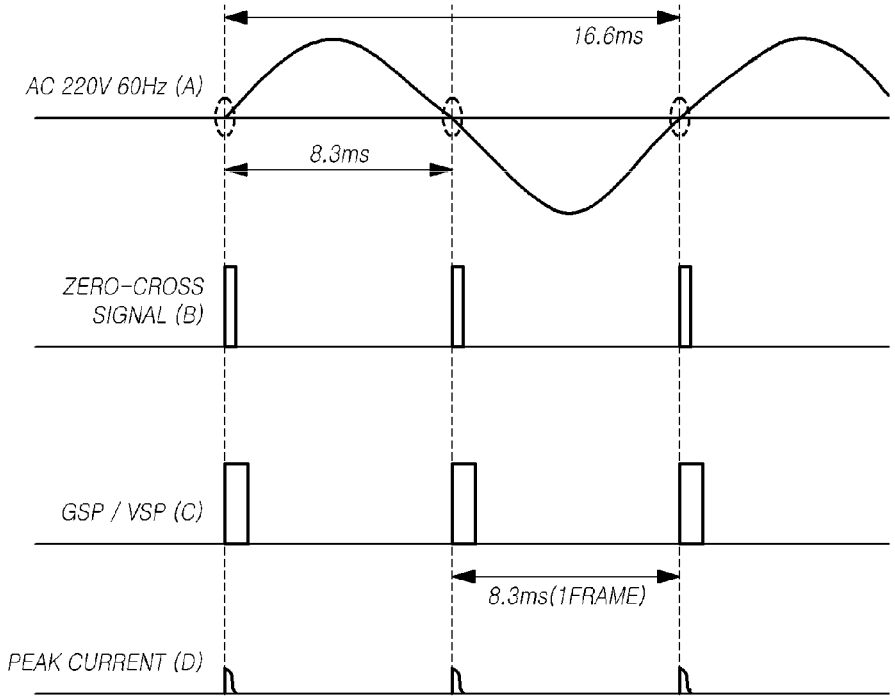
FIG. 6 is a graph illustrating an external power waveform, a zero-cross signal, a gate control signal, a sensing signal, and a peak current.

FIG. 6 is a graph illustrating an external power waveform, a zero-cross signal, a gate control signal, a sensing signal, and a peak current.

The zero-cross signal generated as illustrated in (B) of FIG. 6 in the zero-cross sensing unit 195 as described above is supplied to the timing controller 140.

Upon being provided with the zero-cross signal, the timing controller 140 outputs a gate control signal or a sensing signal synchronized with the zero-cross points included in the zero-cross signal, for example, a gate start pulse GSP/voltage sensing pulse VSP illustrated in (C) of FIG. 6, and provides the gate control signal or the sensing signal to the gate driver 130.

Upon entering the display mode, the timing controller 140 provides the gate control signal as illustrated in (C) of FIG. 6, for example, the gate start pulse GSV/VSP to the gate driver 130 in synchronization with the zero-cross points of the zero-cross signal.

The gate driver 130 sequentially supplies scan signals (the first scan signal SCAN of FIG. 2A) to each of the gate lines (GL in FIG. 1 or GL1 in FIG. 2A) in synchronization with the gate control signal supplied from the timing controller 140 so that each gate is turned ON and the gate lines are driven. Thus, since the gate driver 130 outputs the scan signal of each gate line in synchronization with the zero-cross points of the zero-cross signal, the peak current generated at the time of driving each gate line has a small value that is equal to or less than a predetermined value, as illustrated in (D) of FIG. 6. As the peak current of a load has the value that is equal to or less than a predetermined value like this, it is possible to prevent the voltage of the load from dropping.

Upon entering the sensing mode between the display modes, the timing controller 140 supplies the sensing signal SS synchronized with the zero-cross points of the zero-cross signal as illustrated in (C) of FIG. 6, for example, a gate start pulse GSP/VSP, to the gate driver 130.

Even in this sensing mode, the gate driver 130 should sequentially drive each of the gate lines (GL2 of FIG. 2A) connected to the sensing target pixels.

As a result, the gate driver 130 sequentially provides scan signals (the second scan signal SENSE of FIG. 2A) to be matched with the zero-cross points of the zero-cross signal to each of the gate lines, to which each pixel is connected, so as to drive each gate line. At this time, the mobility and/or threshold value of the driving transistor 203 that drives each pixel are sensed.

Accordingly, as in the display mode, even in the sensing mode, the peak current generated at the time of driving each gate line has a small value that is equal to or less than a predetermined value as illustrated in (D) of FIG. 5. As the peak current of the load has the value that is equal to or less than the predetermined value like this, it is possible to prevent the voltage of the load from dropping.

In the above-described embodiment, descriptions have been made on the case in which a sensing mode is performed in a blank time between display modes so as to sense the mobility of the driving transistor 203 by way of an example. However, the sensing mode may also be performed in the time where the display device 100 is turned OFF. In such a case, the mobility and/or threshold voltage of the driving transistor 203 are sensed, and the timing controller 140 provides a sensing signal SS for sensing in each gate line to the gate driver 130 to be matched with the zero-cross signal, and the gate driver 130 drives each gate line according to the sensing signal.

Figure 7:
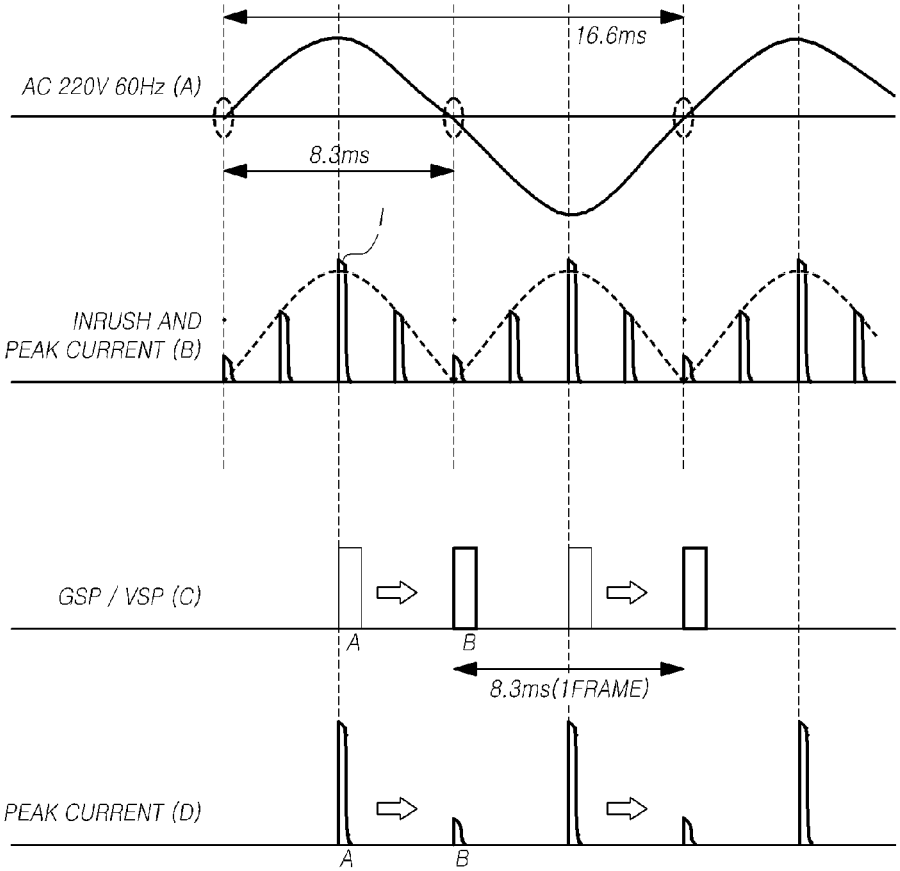
FIG. 7 is a graph illustrating an external power waveform, an inrush and peak current waveform according to a voltage, a gate control signal, and a peak current.

FIG. 7 is a graph illustrating an external power waveform, an inrush and peak current waveform according to a voltage, a gate control signal, and a peak current.

As described above, when an AC power as illustrated in (A) of FIG. 7 is supplied from the external power source 191, the external power supply device 190 according to an embodiment of the present invention senses zero-cross points for the AC power so as to generate a zero-cross signal, and the timing controller 140 of the display device 100 receives the zero-cross signal provided from the external power supply device 190.

In the display mode, the timing controller 140 supplies a gate control signal to the gate driver 130 to be matched with the zero-cross signal so that each of the gate lines are sequentially display-driven to be matched with the zero-cross points. In addition, even in the sensing mode, the timing controller 140 supplies the sensing signal to the gate driver 130 to be matched with the zero-cross signal so that each of the gate lines are sensing-driven to be matched with the zero-cross points. At this time, the gate control signal and the sensing signal are matched with the zero-cross signal, as illustrated in (B) and (C) of FIG. 6.

In the case where the timing controller 140 generates the gate control signal and the sensing signal to be matched with the zero-cross signal as described above, the timing when the gate is turned ON is changed, for example, from point a to point b, as illustrated in (C) of FIG. 7.

If the gate control signal and the sensing signal are generated without being matched with the zero-cross signal, for example, when the gate is turned ON at point a, the gate is turned ON at a state where the voltage of the power source 191 is high, as illustrated in (B) of FIG. 7. Thus, as illustrated in (D) of FIG. 7, a high inrush current I may be generated and thus, the voltage may drop.

However, when the gate control signal and the sensing signal are generated to be matched with the zero-cross signal as in the embodiment of the present invention, that is, when the gate is turned ON at point b, the gate is turned ON in a state where the voltage of the power source 191 is low, as illustrated in (B) of FIG. 7. Thus, as illustrated in (D) of FIG. 7, a low inrush current is generated.

As described above, when the gate of each gate line is driven at a zero-cross point in the display mode and the sensing mode, as illustrated in (D) of FIG. 7, an inrush current with a low peak current is generated as can be seen from point b. Accordingly, in the present embodiment, it is possible to prevent the peak current from being generated over a predetermined level at the time when the gate is turned ON, and as a result, it is possible to prevent the voltage of the display device from dropping due to an excessive inrush current.

Although the technical idea of the present invention have been described above for illustrative purposes, those skilled in the art will appreciate that various modifications and changes are possible without departing from the scope and spirit of the invention. Therefore, the embodiments disclosed in the present invention are not intended to limit, but are intended to describe the technical idea of the present invention, and the technical idea of the present invention is not limited by the embodiments. The protection scope of the present invention shall be construed on the basis of the appended claims in such a manner that all the technical ideas included within the scope equivalent to the claims fall within the protection scope of the present invention.

What is claimed is:

1. An electronic appliance including a display device, the display device connected to an external power supply device detecting a zero-cross signal in a driving power (AC) and providing the driving power and the zero-cross signal to the display device, the display device comprising:

a display panel having a plurality of data lines and a plurality of gate lines crossing each other, a plurality of pixels arranged in matrix form defined by the plurality of data lines and the plurality of gate lines, the plurality of gate lines including a first gate line and a second gate line, the first gate line connected to a first transistor of a pixel from the plurality of pixels, and the second gate line connected to a second transistor of the pixel;

a data driver;

a gate driver;

a power supply unit receiving the driving power provided by the external power supply device and providing at least a high potential power voltage to a plurality of driving voltages lines based on the driving power; and a timing controller adapted to control the data driver and the gate driver based on the zero-cross signal received from the external power supply device, wherein the timing controller is adapted to supply a first scan signal to the first gate line of the gate driver using a first gate start pulse to turn on the first transistor during a display mode during which the display panel displays an image, and supply a second scan signal to the second gate line of the gate driver using a second gate start pulse to turn on the second transistor during a sensing mode during which a characteristic of a driving transistor in the pixel is sensed, the first gate start pulse and the second gate start pulse respectively outputted by the timing controller at corresponding zero-cross points of the AC driving power indicated in the zero-cross signal supplied from the external power supply device for driving the display panel.

2. The electronic appliance of claim 1, wherein the external power supply device is adapted to generate the zero-cross signal for the AC driving power received from outside and to provide the zero-cross signal to the timing controller for enabling the timing controller to output the first gate start pulse and the second gate start pulse to be matched with the zero-cross signal.

3. The electronic appliance of claim 1, wherein the external power supply device comprises at least a zero-cross sensing unit to generate the zero-cross signal.

4. The electronic appliance of claim 3, wherein the timing controller is adapted to output the first gate start pulse and the second gate start pulse to be matched with the zero-cross points included in the zero-cross signal so that a timing when the first gate line is turned ON and a timing when the second gate line is turned ON are matched with the zero-cross points.

5. The electronic appliance of claim 3, wherein the external power supply device further comprises a synchronization unit adapted to rectify the AC driving power to generate a half-wave rectified power and to transfer the rectified power to the zero-cross sensing unit.

6. The electronic appliance of claim 5, wherein the zero-cross sensing unit receives the half-wave rectified power and senses the zero-cross points where the voltage becomes zero in the half-wave rectified power to generate the zero-cross signal.

7. The electronic appliance of claim 6, wherein, the synchronization unit includes a photo coupler performing half-wave rectification on the AC driving power.

8. The electronic appliance of claim 3, wherein the zero-cross sensing unit is adapted to provide the zero-cross signal having zero-cross points detected per every half cycle of the AC driving power to the timing controller.

9. The electronic appliance of claim 1, wherein the power supply device is adapted to generate at least one driving power including one of a driving input voltage, a logic power voltage and a high potential power voltage and to input the driving power to the power supply unit.

10. The electronic appliance of claim 1, wherein the sensing mode starts at a time when a power is turned OFF and the display panel performs a sensing processing according to a power OFF signal to store sensing data in a memory, wherein, when the power is turned ON thereafter, the display panel performs a compensation processing using the stored sensing data.

11. The electronic appliance of claim 10, wherein, while the power is turned ON, the sensing processing is performed in real time and the mode is changed to the sensing mode according to the predetermined timing to perform the sensing processing.

12. The electronic appliance of claim 1, wherein the pixel of the plurality of pixels further comprises:

a light emitting diode (LED); and a driving transistor connected to the light emitting diode, the first transistor, and the second transistor, wherein a gate terminal of the driving transistor is connected to the first transistor, the first transistor configured to turn the driving transistor on and off based on the first scan signal to drive the LED during the display mode, wherein a first terminal of the driving transistor is connected to a driving voltage, and wherein a second terminal of the driving transistor is connected to the second transistor and an anode of the LED, the second transistor configured to sense a voltage at the second terminal during the sensing mode.

13. A method for operating a display device comprising a display panel having a plurality of data lines and a plurality of gate lines crossing each other, a plurality of pixels arranged in matrix form defined by the plurality of data lines and the plurality of gate lines, the plurality of gate lines including a first gate line and a second gate line, the first gate line connected to a first transistor of a pixel from the plurality of pixels, and the second gate line connected to a second transistor of the pixel, a data driver, a gate driver, a power supply unit, and a timing controller, the method comprising:

receiving a driving power (AC) and a zero-cross signal in the driving power from an external power supply device;

providing at least a high potential power voltage to the plurality of driving voltage lines;

supplying, based on the zero-cross signal received from the external power supply device, a first scan signal to the first gate line of the gate driver using a first gate start pulse to turn on the first transistor during a display mode during which the display panel displays an image, and supply a second scan signal to the second gate line of the gate driver using a second gate start pulse to turn on the second transistor during a sensing mode during which a characteristic of a driving transistor in the pixel is sensed, the first gate start pulse and the second gate start pulse respectively outputted by the timing controller at corresponding detected zero-cross points of the AC driving power indicated in the zero-cross signal.

* * * * *